US005938254A

United States Patent [19]

Weyerstall

[11] Patent Number: 5,938,254

[45] Date of Patent: Aug. 17, 1999

[54] STRIKER DRIVE ASSEMBLY FOR A MOTOR VEHICLE DOOR LOCK OR THE LIKE

[75] Inventor: Bernd Weyerstall, Wuppertal, Germany

[73] Assignee: Robert Bosch GmbH, Stuttgart, Germany

[21] Appl. No.: 08/933,343

[22] Filed: Sep. 19, 1997

[30] Foreign Application Priority Data

| | | | |
|---|---|---|---|
| Oct. 8, 1996 | [DE] | Germany | 196 41 175 |
| Jul. 16, 1997 | [DE] | Germany | 197 30 386 |
| Aug. 30, 1997 | [DE] | Germany | 197 37 996 |

[51] Int. Cl.[6] ..... E05B 15/02

[52] U.S. Cl. ..... 292/341.16; 292/341.15; 292/144; 292/201

[58] Field of Search ..... 292/341.16, 201, 292/144, DIG. 43, 340, 341.15

[56] References Cited

U.S. PATENT DOCUMENTS

| | | | |
|---|---|---|---|
| 4,113,293 | 9/1978 | Paquette | 292/341.18 |
| 4,707,007 | 11/1987 | Inoh . | |
| 4,775,178 | 10/1988 | Boyko | 292/341.16 |
| 4,785,493 | 11/1988 | Tillman | 16/53 |
| 4,982,984 | 1/1991 | Yokota et al. . | |
| 5,273,325 | 12/1993 | Zimmerman | 292/216 |
| 5,632,515 | 5/1997 | Dowling | 292/216 |
| 5,755,468 | 5/1998 | Buchanan | 292/341.16 |
| 5,765,886 | 6/1998 | Buchanan | 292/341.16 |

*Primary Examiner*—Steven Meyers
*Assistant Examiner*—Gary Estremsky
*Attorney, Agent, or Firm*—Sixbey, Friedman, Leedom & Ferguson; David S. Safran

[57] ABSTRACT

A striker drive assembly for a motor vehicle door lock or the like, with a drive motor and downstream gearing, with a linearly movable striker carrier which is driven by a drive element, preferably by a cam (13), and with a striker which is attached to the striker carrier (3), the striker carrier (3) being positioned to move in a housing (7) to which the drive motor is joined. This striker drive assembly behaves as much as possible like a striker attached stationary due to the fact that the striker carrier (3) can be displaced from the open position (preclosing position) mechanically without hindrance by the drive element, into the closed position (main closing position), especially without hindrance by the cam (13).

19 Claims, 5 Drawing Sheets

FIG. 1
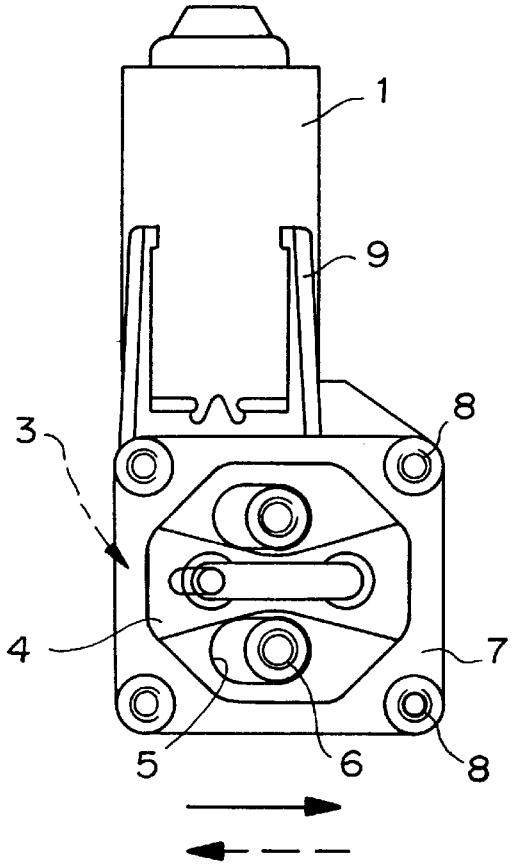
FIG. 2
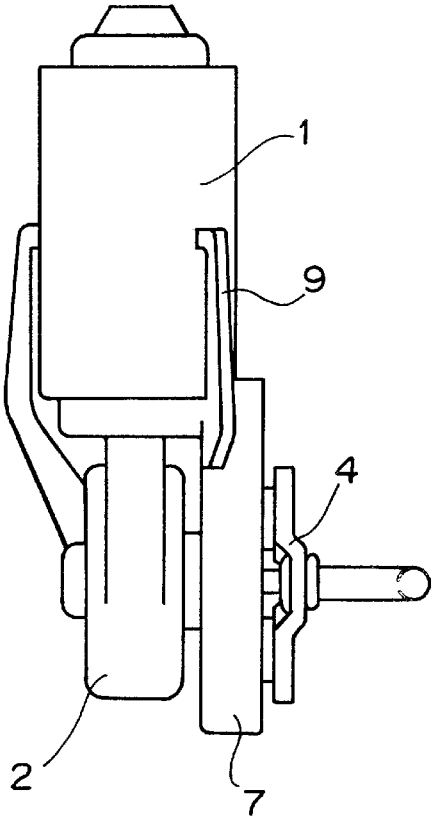
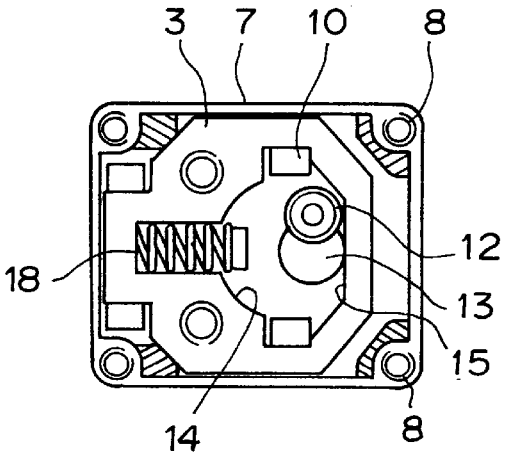
FIG. 3
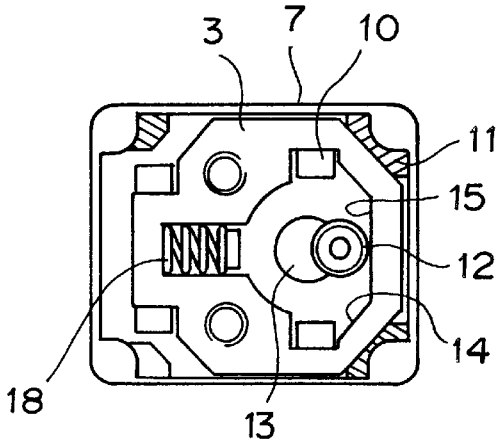
FIG. 4

STRIKER DRIVE ASSEMBLY FOR A MOTOR VEHICLE DOOR LOCK OR THE LIKE

BACKGROUND OF THE INVENTION

1. Field of the Invention

The invention relates to a striker drive assembly for a motor vehicle door lock or the like with a drive that, preferably, has a drive motor with a downstream gearing. In particular, the invention relates to such a striker drive assembly which is provided with a linearly movable striker carrier which is positioned to move in a housing to which the drive is joined and which can be motor-driven by means of a drive element, preferably by means of a cam, and with a striker which is attached to the striker carrier.

2. Description of Related Art

Motor vehicle door locks or the like which are provided with a motor-driven closing aid to make operation easier have been known for some time. Motorized closing aids in locks for tailgates and rear doors are very common, but in the meantime, motorized closing aids for motor vehicle side doors are also becoming more popular.

In a first type of motor vehicle door lock or the like, the motorized closing aid is assigned to the latch, while the striker on the opposite part of the car body, for example, the B pillar or C pillar, is stationary and is used as an abutment.

The aforementioned first type of motorized closing aid is advantageous, but also has construction and operating problems. To solve these problems, a second type of motor vehicle door lock or the like has become known in which the motorized closing aid is assigned to the striker instead of to the latch. This yields a striker drive assembly on the corresponding part of the car body, for example, on the B pillar or the C pillar. A striker drive assembly on a stationary part of the car body, for example, the B pillar, has various advantages. The actuating mechanism and central interlock of the motor vehicle door lock or the like are independent of the drive means of the closing aid. The drive means of the closing aid is stationary on the car body, and is not exposed to high accelerations when the motor vehicle door is slammed shut. Structurally bypassing the drive motor of the drive means, which is necessary for safety reasons for purposes of emergency opening, is produced by itself since the actuating mechanism remains effective for manual actuation with respect to the latch, regardless of the position the striker moved by the drive means.

A striker drive assembly of the type to which the present invention is directed having a linearly movable striker carrier is known from U.S. Pat. Nos. 4,707,007 and 4,982,984. This striker drive assembly can be used in side doors, rear doors, tailgates, trunk decks, hoods, or the like.

In the known striker drive assembly, first of all, the striker is detachably and interchangeably attached to the striker carrier. It is specifically screwed on the striker carrier there. Thus, the striker drive assembly can be universally used since, for each type of motor vehicle, the suitable desired striker can be attached to the striker carrier, for example, a wedge-shaped striker, a striker made as a closing clip, a striker made as a bolt, etc.

In the known striker drive assembly, the striker carrier is positioned to move in a housing to which the drive means is permanently joined. The drive means, here, comprises an electrical drive motor and a step-down gear made as toothed gearing. As an alternative, other drive motors (hydraulic, pneumatic), other gearing (worm gear pair) and direct drives (hydraulic cylinder with rack) etc. are mentioned. The assembly consisting of the housing and drive means itself is then provided with attachment means for attachment to the desired car body part. These attachment means, in the prior art, are mounting screws, i.e., the assembly is attached to the car body, as were the earlier pure strikers, without drive assemblies.

In the known striker drive assembly, the striker carrier can be driven via a cam which fits into a receptacle on the striker carrier. On the edge of the receptacle, in the striker carrier, a force transmission surface is formed against which the cam rests with low friction to transmit force. The size of the receptacle is tailored to the size of the cam; thus, the striker carrier follows each movement of the cam. In the above explained known striker drive assembly with a linearly movable striker carrier to which the invention is directed, vigorous slamming of the motor vehicle door, at the same time, loads the cam because the striker cannot yield. In the open position (preclosing position), the striker is blocked if the drive means should fail when the cam is in the open position (preclosing position). The motor vehicle door then only reaches the "precatch"; this is acceptable for a certain time in terms of safety engineering, but is uncomfortable.

Otherwise, the behavior of the striker drive assembly, aside from the linear movability of the striker carrier, should correspond as much as possible to the behavior of a striker screwed stationary onto the car body part without a drive means.

SUMMARY OF THE INVENTION

The present invention therefore has a primary object to provide improve the aforementioned known striker drive assembly with linearly movable striker carrier such that, when the drive means fails, reliable closing of the motor vehicle door can always be achieved and the striker drive assembly behaves as much as possible like a striker attached stationary.

This object is achieved in accordance with preferred embodiments of the present invention by providing a striker drive assembly in which the striker carrier can be mechanically displaced from the open position (preclosing position) without hindrance by the drive element, into the closed position (main closing position) especially without hindrance by the cam. In accordance with the invention, the construction is such that the striker carrier follows the drive motion of the drive element, but an inherent motion of the striker carrier initiated from the striker does not act on the drive element. If the drive element, especially therefore the cam, is in the open position (preclosing position), the motor vehicle door can be slammed without immediately loading the drive element, especially the cam, with force.

For the embodiment of the drive element as a cam, an especially simple execution is achieved by use of a one-sided freewheel between the cam and striker carrier and is preferred.

It is especially feasible to equip the striker carrier with a spring element which applies a spring force to it in the opening direction. Thus, a certain position of the striker carrier, which is accomplished by spring force, is achieved relative to the drive element and the force on the striker carrier is absorbed by the spring element (in part) when the door is slammed.

Furthermore, in an embodiment of special importance, a manual actuation means in combination with the absence of hindrance to the striker carrier leads to the fact that, in an emergency, specifically when the drive means fails, the striker carrier together with the striker can be moved into the closed position (main closing position) beforehand and fixed there. At this point, the door need simply be slammed somewhat more strongly and forcefully since there is no motorized closing aid which moves the striker carrier. However, when the door is forcefully slammed, it ultimately reaches the closed position (main closing position) as in a normal case. Therefore, in the case of an emergency, this striker is converted by the action of the manual actuation means into a stationary striker which cannot be moved by motor.

The providing of impact buffers for the striker carrier in the housing supporting the striker carrier in the housing on rollers, cylinders or balls are important features for absorbing forces and for optimum mobility of the striker carrier.

This is reminiscent of how the striker drive assembly in the emergency case corresponds in its behavior to a fixed striker. This behavior is also improved as claimed in the invention for certain areas in another manner. Furthermore, providing adjustability for the bearings of the striker carrier leads to the striker itself being as stationary as possible with the door closed, so that the noise during driving is as little as possible. Special measures for achieving this adjustability are that, for adjustment of each bearing, there is bearing body at least on one side of the striker carrier which, for its part, is adjustable in a direction perpendicular to the direction of motion of striker carrier. The rear of the bearing body may be made as a wedge guide, and the bearing body forms a bearing surface for rollers or carries rollers, preferably in bearing shells.

Furthermore, the entire striker drive assembly, like a normal stationary striker, should also be statically adjustable basically with respect to the lock in the motor vehicle door. In particular, the striker drive assembly, as a whole, is provided with attachment means for the attachment thereof to the desired car body part; but, in the attached state, the drive assembly is slightly adjustable relative to the car body part and can be fixed in the respective adjustment position.

These and further objects, features and advantages of the present invention will become apparent from the following description when taken in connection with the accompanying drawings which, for purposes of illustration only, show several embodiments in accordance with the present invention.

BRIEF DESCRIPTION OF THE DRAWINGS

FIG. 1 shows a front view of a first embodiment of a striker drive assembly in accordance with the invention and showing the side of the striker;

FIG. 2 is a side view showing the striker drive assembly from the left in FIG. 1;

FIG. 3 shows the housing for the striker carrier of the drive assembly of FIG. 1 with the striker carrier in the open position (preopening position);

FIG. 4 is a representation of the striker carrier corresponding to FIG. 3 in the min closing position;

DETAILED DESCRIPTION OF THE PREFERRED EMBODIMENTS

Figure 5:
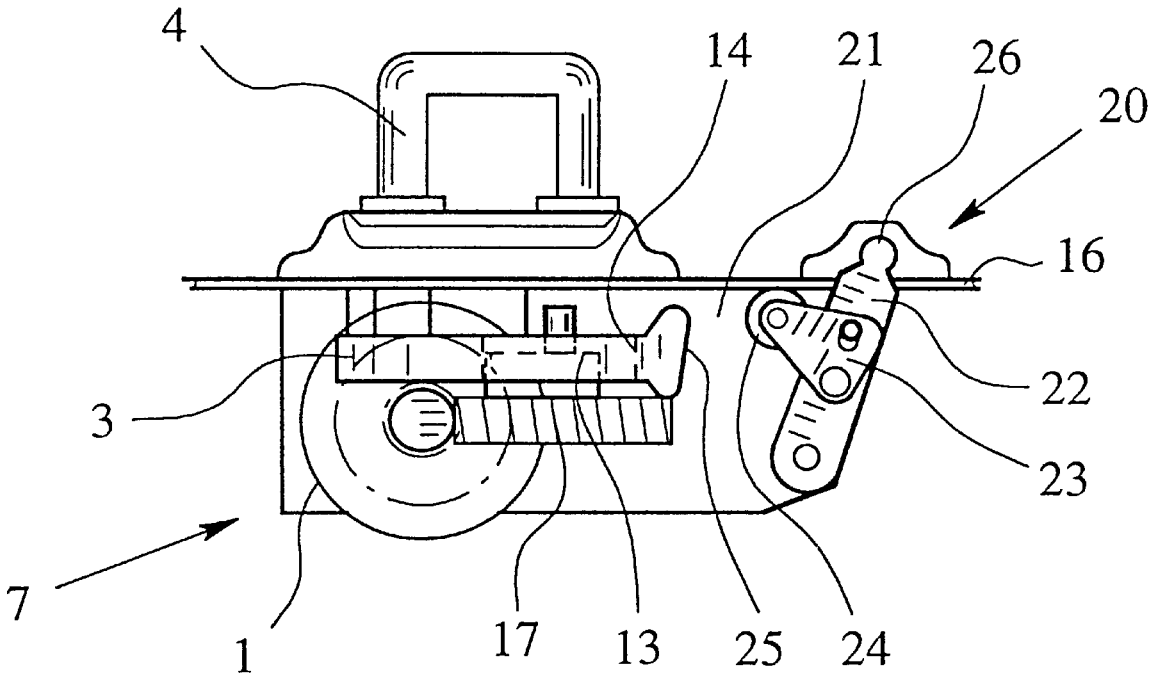
FIG. 5 is a side view of a striker drive assembly similar to FIG. 1 but with a manual actuation means, the striker carrier being shown in the closed position (main closing position) and the manual actuation means in the "free" operating position.

The teaching of the invention relates to a striker drive assembly for a motor vehicle door lock or another mechanism on a car body part in a motor vehicle car body, for example a rear door, tailgate, trunk deck, hood, backrest interlock, or the like.

FIGS. 1 and 2 show a first embodiment having a drive motor 1 which will generally be an electric drive motor. However, in principle, pneumatic or hydraulic drive motors are usable as mentioned in the Background portion of this specification. Gearing 2 is adjusted to be driven by drive motor 1, and together, they form a drive means 1, 2. Gearing 2 drives a striker carrier is for the purposes of linear displacement a striker 4 thereon. The linear displacement is shown in FIG. 1 by two arrows. Since striker 4 on striker carrier is, here, is in the main closing position, it can move in the indicated longitudinal holes 5 out of this position to the left (represented by the broken line arrow) into the preclosing position; the return movement is shown by the solid line arrow.

Attachment screw 6 on striker 4 in FIG. 1 shows that striker 4 on striker carrier 3 is detachably and interchangeably joined. Its importance has been explained in detail in the general part of the description. Therefore, striker 4 can be removed from striker carrier 3 by loosening attachment screw 6, so that striker 4 can be replaced by another striker 4. As a result, the striker drive assembly can be used universally, specifically, in conjunction with all types of strikers 4.

The illustrated embodiment of a striker drive assembly has an especially high degree of integration; this allows flexible installation at different points or on different car body parts. For this reason, it is provided that striker carrier 3 is positioned to move in the housing 7 to which the drive motor 1 is securely joined, and that this assembly of housing 7 and drive motor 1 is provided with attachment means 8 for attachment of the assembly to the desired car body point or part, e.g., body sheet metal 16. FIGS. 1 and 2 also show retaining clamps 9 to which drive motor 1 with housing 7 for gearing 2 and striker carrier 3 is clamped. Attachment means 8 are the four threaded holes located in the corners, via which housing 7 and thus the entire assembly can be attached to a car body part.

FIGS. 3 and 4 show one special embodiment which preferably operates without jamming. Instead of a slide bearing of striker carrier 3, here, striker carrier 3 is supported on rollers 10 in the housing 7. Four rollers 10 are recognizable here. Furthermore, FIGS. 3 and 4 show that impact buffers 11 for striker carrier 3 are provided in housing 7. Impact buffers 11 are made of elastomeric plastic and they reduce impact noise when the door is slammed. Corresponding impact buffers 11 on the opposite side also prevent especially loud noise when the door opens.

The embodiment shown is characterized by an especially practical construction of gearing 2 which increases the degree of integration of the drive assembly. It is provided, here, that striker carrier 3 can be driven preferably via a cam 13 which is preferably provided with a roller 12. Here, it is recognized that striker carrier 3 has a receptacle 14 into which cam 13 fits outside of gearing 2. This receptacle 14 is located in the middle of the plate-like striker carrier 3; therefore, it is closed on all sides. However, this need not be the case; receptacle 14 can also be open on one side. It is significant that, on the edge of receptacle 14, a force transmission surface 15 is formed against which cam 13 is engaged to transmit force. Force transmission surface 15 is on the right in FIG. 3, on the inside of receptacle 14. Furthermore, it is apparent that the main closing position of FIG. 4 is reached from the preclosing position (opening position) of FIG. 3 by turning cam 13 to the right. The lift is a few millimeters, in the embodiment shown, roughly 6 mm. By moving the cam 13, striker carrier 3 is pressed against stop buffer 11 on the right in housing 7. This is then the main closing position. In FIG. 4, the forces acting in the opening direction do not engage cam 13 via a lever arm through dead center of cam 13, but they are deflected directly into the axis.

Gearing 2 is made as a worm gear pair. Cam 13 is located on worm wheel 17 of the worm gear pair.

The embodiments in FIGS. 1 to 4 are characterized by the fact that striker carrier 3 is provided with a spring element 18 which applies spring force to the striker carrier 3 in the opening direction (preclosing position). This is also present in the other embodiments even though not illustrated.

In the embodiment shown, it is provided that striker carrier 3 can be mechanically displaced from the open position (preclosing position) without hindrance by the drive element, i. e., in the embodiment shown, into the closing position (main closing position) without hindrance by the cam 13.

Its importance has been explained in the Background part of this specification. If there is impact on striker 4 coming from the left in FIG. 3, and thus, on striker carrier 3 directed to the right, the striker carrier 3 easily reaches the main closing position shown in FIG. 4 without hindrance by cam 13 against the spring force of spring element 18. Spring element 18 is shown more strongly compressed there in FIG. 4. The receptacle 14 in striker carrier 3 is flared to the left such that cam 13 does not reach the opposite edge of receptacle 14. Here, a free space for the cam 13 is produced by having the cam execute only a 90° rotation between the open position and the closed position; but, the clearance of the receptacle 14 in the direction of motion of striker carrier 3 is somewhat greater than the outside diameter of the path of cam 13. Thus, the cam in receptacle 14 can execute a complete revolution, i.e., can turn 270° from the closed position in FIG. 4 into the open position of FIG. 3 in the same direction of rotation.

This allows use of a drive motor 1 which does not work in reverse; this occasionally has advantages.

For the embodiment from FIGS. 1–4 one closing process and one opening process will be explained.

When the motor vehicle door is closed, it is slammed, the latch meets striker 4 and is locked in the main catch by the detent pawl. The momentum which results from the slamming of the vehicle door displaces striker 4, against the spring force of spring element 18 together with striker carrier 3, from the position shown in FIG. 3 to the one shown in FIG. 4 until it strikes impact buffers 11. Hard impact noise is thus suppressed.

For example, because the catch has reached the main catch position, a switching pulse is triggered and drive motor 1 is turned on. The door rebounding initially from impact buffers 11 with the cooperation of spring element 18 is then moved by the motor into the main closing position by cam 13 moving out of the preclosing position shown in FIG. 3 into the main closing position shown in FIG. 4 and remaining there. The drive motor 1 is turned off. The motor vehicle door is closed.

Depending on the functional equipment of the motor vehicle, to open the motor vehicle door, either the door handle is pulled or a control pulse is triggered. In both cases, drive motor 1 is triggered so that cam 13 returns from the main closing position of FIG. 4 into the preclosing position of FIG. 3, and the detent pawl releases the latch from the main catch at the same time or offset in time. The door is opened, and striker carrier 3 with striker 4 has again reached the position of FIG. 3.

Electric drive motor 1 can be controlled via switches or via a solid state circuit; electric drive motor 1 can be adjusted to run clockwise and counterclockwise. The three dimensional location of the striker drive assembly of the invention in the motor vehicle body is optional, vertical, horizontal or suspended being possible.

Even if drive motor 1 fails with cam 13 in the open position (preclosing position), striker carrier 3 can be moved into the closed position (main closing position). This is apparent from the aforementioned explanation.

Figure 6:
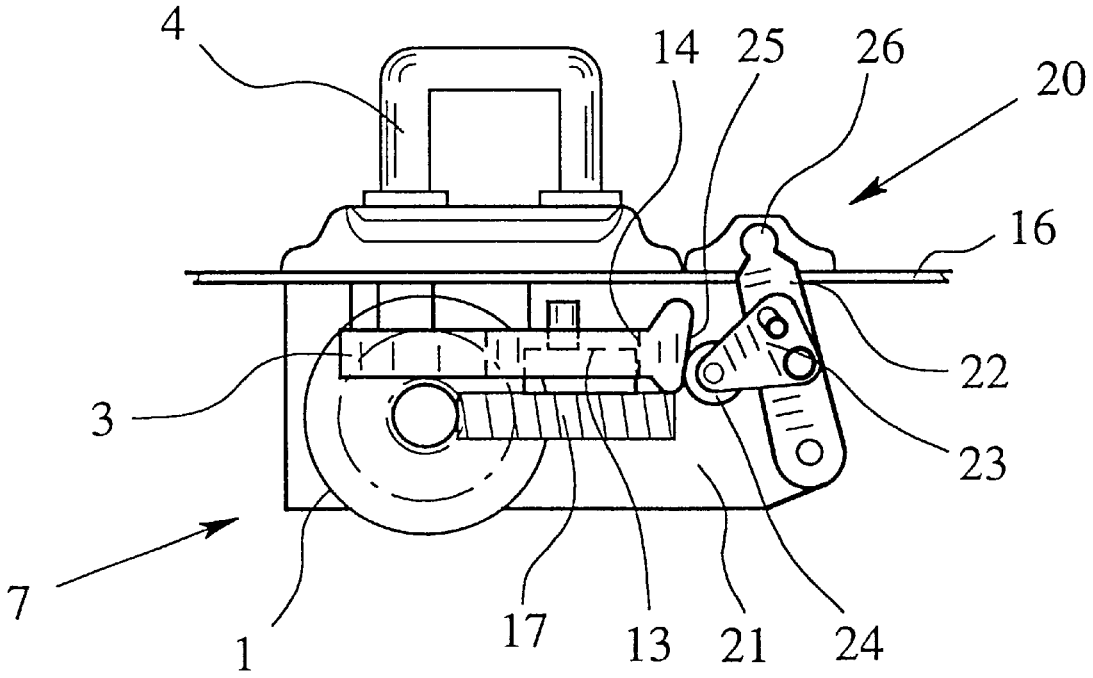
FIG. 6 is a view corresponding to FIG. 5 with the striker carrier and the cam the open position (preclosing position), but the manual actuation mean, the "fixed" position.

FIGS. 5 and 6, together, show that displacement can also be obtained mechanically into the closed position (main closing position) by a manual actuation means 20. The importance of this manual actuation means 20 for an emergency has been explained in the Background portion of this specification.

FIG. 5 shows manual actuation means 20 in a "free" position, in which striker carrier 3 is only driven by the motor 1. Conversely, FIG. 6 in a side view corresponding to FIG. 5 shows that, here, manual actuation means 20 has been moved into the "fixed" operating position. In the fixed operating position, the striker carrier 3 is fixed in the closed position (main closing position). In this way, striker 4 acts as a stationary striker; the motorized closing aid is inoperative.

FIGS. 5 & 6 show an embodiment of manual actuation means 20 with a manual actuation lever 22 supported on the housing 7, specifically on carrier plate 21, a transfer arm 23 being fixed to it with a support roller 24 resting against a force transmission surface 25 on striker carrier 3. An actuating slide 26 which is used for shifting of lever 22 is located on the top of the car body sheet metal 16.

If it is ascertained that for some reason the electric motor drive assembly is not operating, the motor vehicle door is opened and actuating slide 26 is pushed into the "fixed" position (FIG. 6) so that striker carrier 3 is moved into the closed position (main closing position) and is fixed there. The top dead center construction of manual actuation means 20 ensures that vibrations cannot cancel the fixed position of striker carrier 3.

The advantage of the design of the invention lies in secure door closing even in an emergency. The disadvantage in an emergency consists simply in that the motor vehicle door must be slammed more forcefully, because the counterpressure of the sealing rubber and possibly the counterpressure of the opening spring must be overcome; this is otherwise handled by the motorized closing aid in normal operation.

Figure 7:
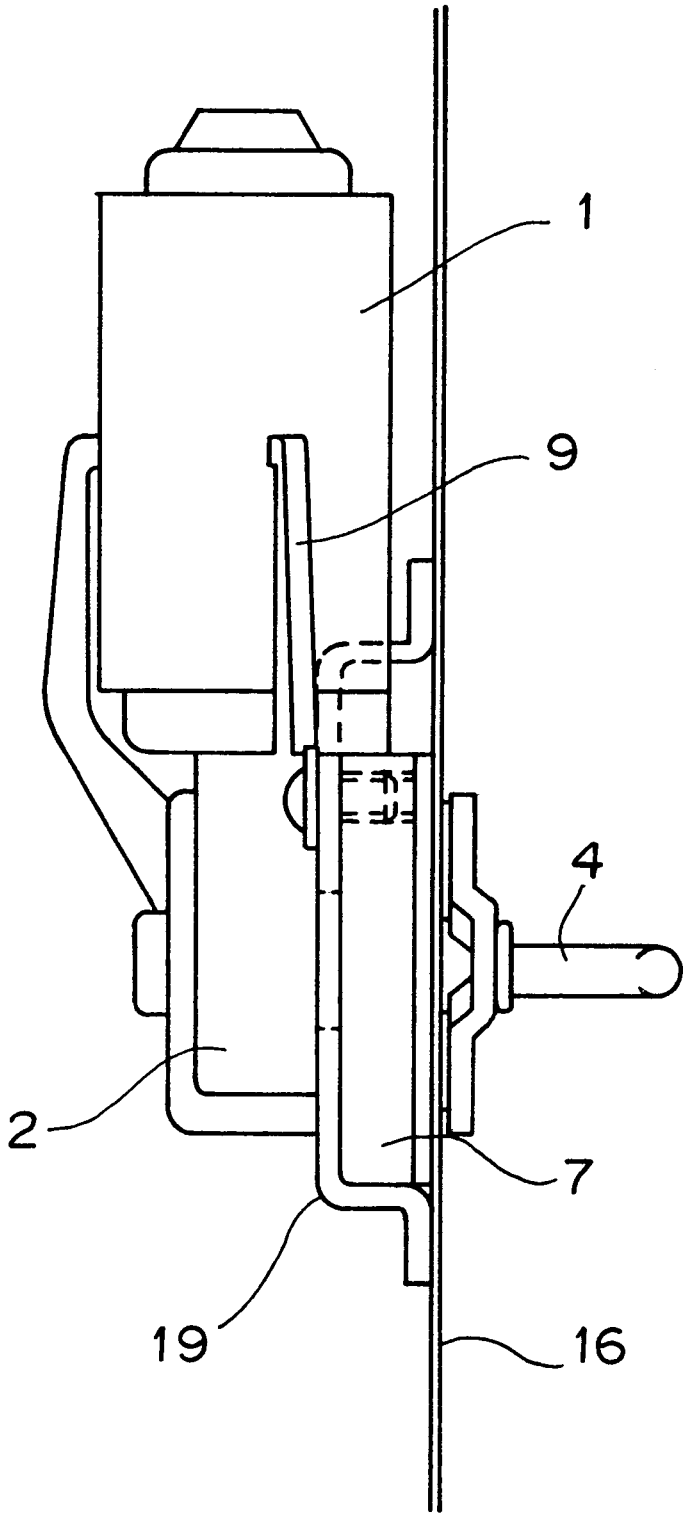
FIG. 7 shows a side elevational view of a third embodiment of a striker drive assembly attached to a car body part.

FIG. 7 shows another alternative which essentially can correspond to the above explained embodiment. Here, housing 7 is simply provided with an additional receiver pocket 19 to which it is attached via the attachment means 8 shown in FIGS. 3 & 4. Receiver pocket 19 itself is then attached to car body part 16 by welding or another attachment technique.

Figure 8:
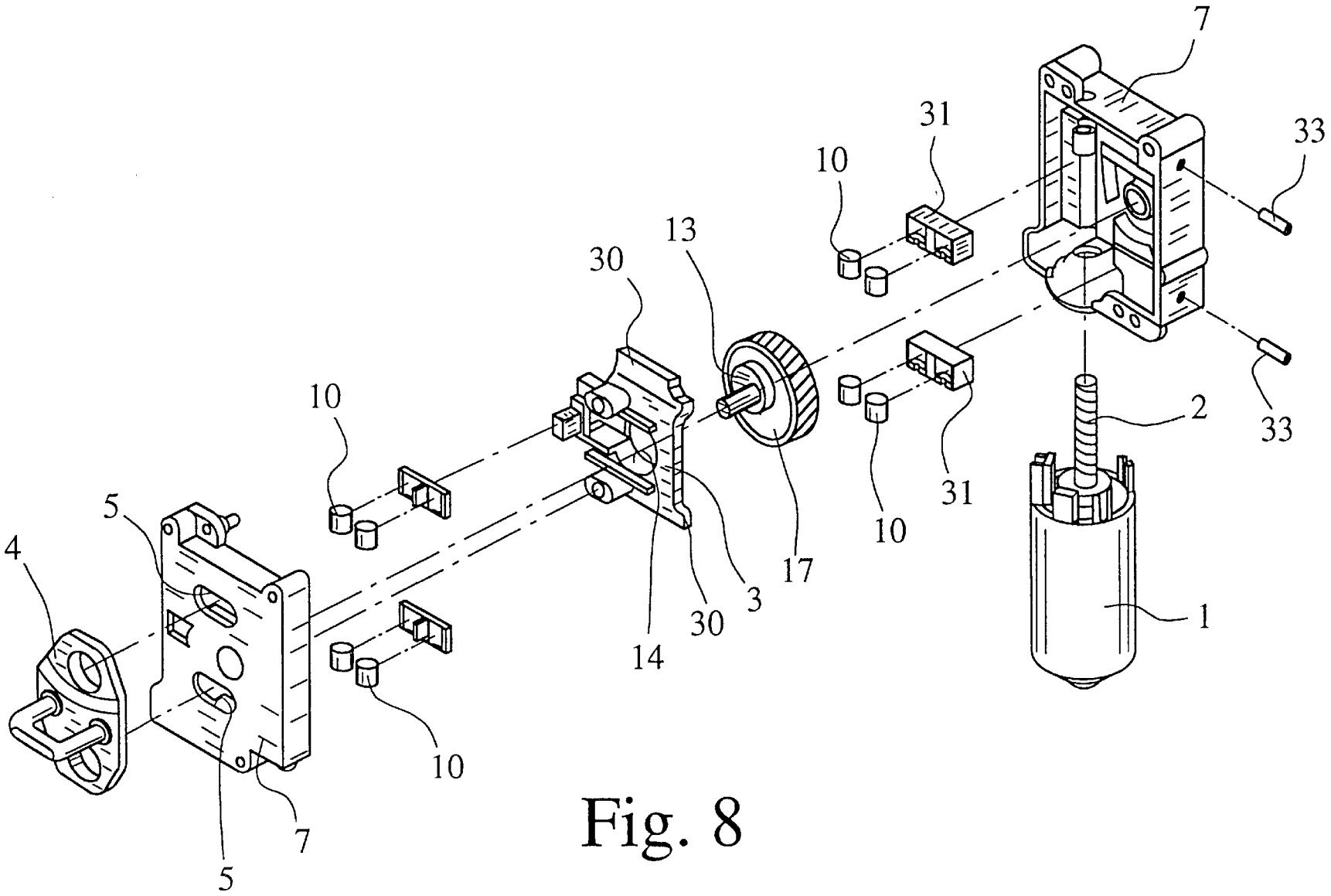
FIG. 8 is an exploded view of a fourth embodiment of a striker drive assembly according to the invention.

FIG. 8 shows an exploded view of another embodiment of a striker drive assembly according to the invention. The reference numbers which have already been used have been applied to corresponding elements in this embodiment and to the extent the components identified by such reference numbers have already been discussed, they are not explained again.

In the embodiment shown in FIG. 8, as in the embodiment shown in FIGS. 5 & 6, it is provided that the receiver 14 in striker carrier 3 has a clearance in the direction of motion of the carrier which corresponds to the outside diameter of the path of cam 13. In this way, cam 13 can execute 180° motion between the open position and closed position, and therefore, can be at dead center positions corresponding to the two dead center positions are shown in FIG. 5 & 6.

Figure 9:
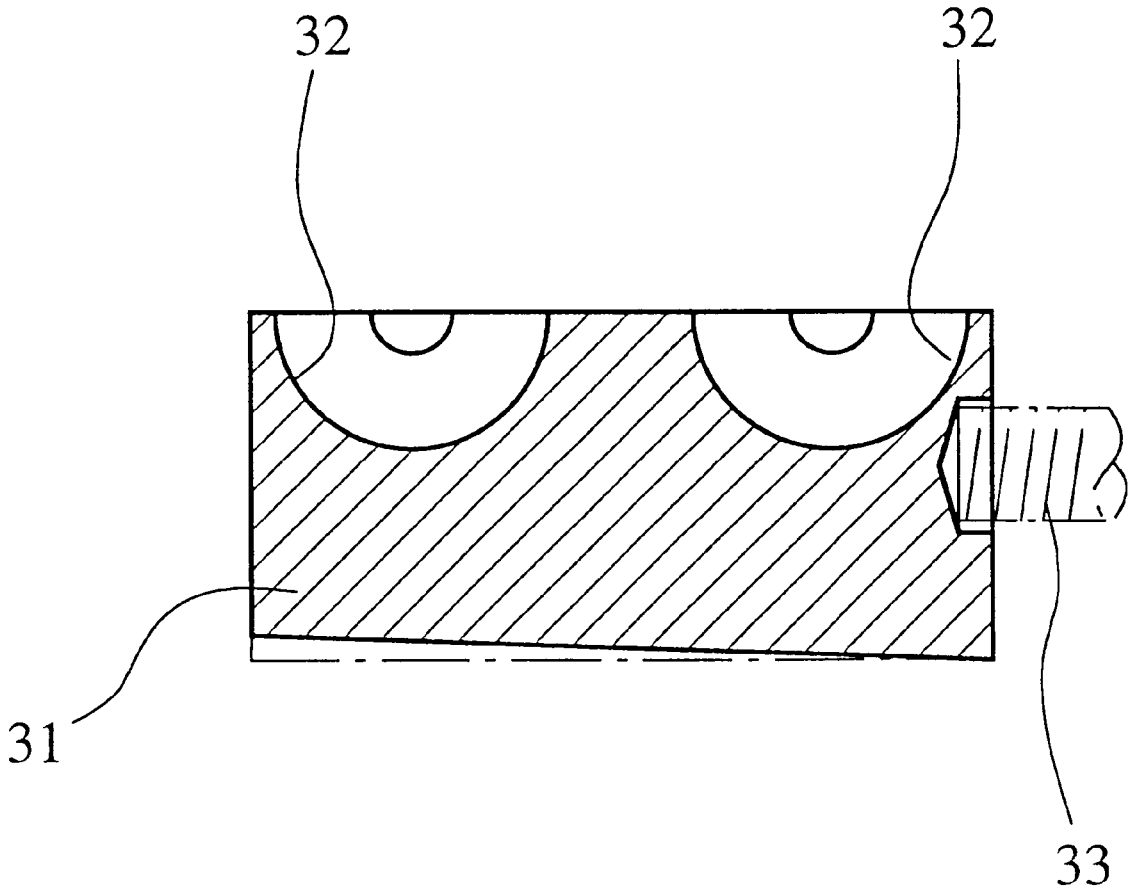
FIG. 9 a cross-sectional view of a bearing body of the striker drive assembly of FIG. 8.

The embodiment shown in FIG. 8 shows rollers 10 which form bearings on which the striker carrier 3 is supported in housing 7, the rollers 10 being located in housing 7 on either side of spring-like guides 30 at the top and bottom of striker carrier 3, so that they are held between rollers 10. These bearings of striker carrier 3 are adjustable due to the fact that, at least on one side of striker carrier 3 (e.g., the side shown on the right in FIG. 8), there are bearing bodies 31 which are adjustable in the directions perpendicular to the directions of motion of striker carrier 3. Each bearing body 31 holds two rollers 10, here, in bearing shells 32 (FIG. 9). The adjustability of bearing bodies 31, in this embodiment, is accomplished by two grub screws 33 which are screwed through housing 7 into engagement with the bearing bodies 31. FIG. 9 shows that the back of the bearing body 31, in the embodiment shown, is made as a wedge guide, interacting with a corresponding wedge surface on housing 7. By turning the screw 33, bearing body 31 is shifted in the displacement direction of striker carrier 3, and in this way, as a result of the wedge action of the wedge guide is moved at the same time perpendicular to the direction of movement of striker carrier 3 and is thus adjusted relative to guide 30. Thus, play at this point can be effectively eliminated, so that the motor vehicle door lock is for the most part noiseless.

Finally, a corresponding configuration of attachment points makes it possible for the striker drive assembly to be provided as a whole with attachment means 8 for attachment to desired car body part 16, but in the attached state it is slightly adjustable relative to the body part 16 and can be fixed in the respective adjustment position. This can be done with accordingly large through holes or also with cage nuts in the gear housing. Basically, this technique corresponds to adjustability of an otherwise stationary striker on the stationary car body part for purposes of calibration of door closing.

While various embodiments in accordance with the present invention have been shown and described, it is understood that the invention is not limited thereto, and is susceptible to numerous changes and modifications as known to those skilled in the art. Therefore, this invention is not limited to the details shown and described herein, and includes all such changes and modifications as are encompassed by the scope of the appended claims.

I claim:

1. A striker drive assembly for a motor vehicle door lock comprising:

a drive means having a housing joined thereto and comprising a drive motor and a gearing downstream in driven connection with the drive motor;

a cam driven by said gearing;

a linearly movable striker carrier which is driven by means of said cam and which is positioned to move in said housing along a linear path;

a striker which is attached to the striker carrier, the striker carrier having a receiver in which the cam is located;

wherein the striker carrier is provided with a spring element which applies spring force to it in an opening direction; and wherein the receiver has a clearance in a direction of motion of the striker carrier along said linear path, said clearance being at least equal to an outer diameter of a path of rotary movement of the cam, said clearance enabling mechanical displacement of the striker carrier from said open position into said closed without hindrance by the cam when the cam is in an open position out of driven connection with the drive motor.

2. Drive assembly as claimed in claim 1, further comprising a manual actuation means for mechanically moving the striker carrier into the closed position and fixing the striker carrier therein.

3. Drive assembly as claimed in claim 2, wherein the manual actuation means is a top dead center lever arrangement.

4. Drive assembly as claimed in claim 2, wherein the manual actuation means is supported on said housing.

5. Drive assembly as claimed in claim 2, wherein an actuating slide is provided for actuating the manual actuation means.

6. Drive assembly as claimed in claim 1, wherein the striker carrier is supported in the housing on bearings selected from the group consisting of rollers, cylinders and balls.

7. Drive assembly as claimed in claim 6, wherein means for adjusting the bearings supporting the striker carrier are provided.

8. Drive assembly as claimed in claim 1, wherein the drive means, gearing, drive element an striker carrier form a striker drive assembly which, as a whole, is provided with attachment means for attachment thereof to a car body part in a manner which is slightly adjustable and securable in an adjusted position.

9. Drive assembly as claimed in claim 1, wherein the striker carrier is provided with a spring element which applies spring force to it in an opening direction.

10. Drive assembly as claimed in claim 1, further comprising a manual actuation means for mechanically moving the striker carrier into the closed position and fixing the striker carrier therein.

11. Drive assembly as claimed in claim 1, wherein impact buffers for the striker carrier are provided in said housing.

12. A striker drive assembly for a motor vehicle door lock comprising:

a drive means having a housing joined thereto;

a gearing downstream in driven connection with the drive means;

a drive element driven by said gearing;

a linearly movable striker carrier which is driven by means of said drive element and which is positioned to move in said housing;

a striker which is attached to the striker carrier;

means for mechanically displacing the striker carrier from an open position into a closed position without hindrance by the drive element; wherein the striker carrier is supported in the housing on bearings selected from the group consisting of rollers, cylinders and balls; wherein means for adjusting the bearings supporting the striker carrier are provided; and wherein at least one bearing body is provided on at least one side of the striker carrier for adjustment of the bearings, said at least one bearing body being adjustable in a direction perpendicular to a direction of motion of the striker carrier.

13. Drive assembly as claimed in claim 12, wherein said at least one bearing body is made as a wedge guide on a back side thereof.

14. Drive assembly as claimed in claim 12, wherein said bearings are rollers and said at least one bearing body forms a bearing surface for the rollers.

15. Drive assembly as claimed in claim 12, wherein said drive means comprises a drive motor and said drive element comprises a cam driven by said gearing.

16. Drive assembly as claimed in claim 15, wherein the striker carrier has a receiver in which the cam is located; and wherein the receiver in the striker carrier has a clearance in a direction of motion of the striker carrier which corresponds to an outer diameter of a path of movement of the cam.

17. Drive assembly as claimed in claim 16, wherein the striker carrier is provided with a spring element which applies spring force to it in an opening direction.

18. Drive assembly as claimed in claim 17, wherein impact buffers for the striker carrier are provided in said housing.

19. A striker drive assembly for a motor vehicle door lock comprising:

a drive means having a housing joined thereto;

a gearing in downstream driven connection with the drive means;

a drive element driven by said gearing and having an open position out of driven connection with the drive means;

a linearly movable striker carrier which is driven by means of said drive element and which is positioned to move in said housing along a linear path;

a striker which is attached to the striker carrier, the striker carrier having a receiver in which the drive element is located;

a spring element which applies spring force to the striker carrier in an opening direction;

a manual actuation means for mechanically moving the striker into a closed position and for fixing the striker in said closed position; and means for enabling mechanical displacement of the striker carrier from an open position into said closed without hindrance by the drive element when the drive element is in said open position out of driven connection with the drive motor.

* * * * *